United States Patent [19]

Bryson

[11] Patent Number: 4,646,873

[45] Date of Patent: Mar. 3, 1987

[54] MICROPHONE AND ACOUSTIC EQUALIZER THEREFOR

[75] Inventor: Michael A. Bryson, Buchanan, Mich.

[73] Assignee: Electro-Voice, Inc., Buchanan, Mich.

[21] Appl. No.: 836,237

[22] Filed: Mar. 4, 1986

[51] Int. Cl.[4] ..... H04R 7/00

[52] U.S. Cl. ..... 181/160; 181/158

[58] Field of Search ..... 181/158, 160; 381/91

[56] References Cited

U.S. PATENT DOCUMENTS

| | | | |
|---|---|---|---|
| 2,205,670 | 6/1940 | Pye | 181/160 X |
| 2,672,525 | 3/1954 | Pye | 181/160 X |
| 3,204,031 | 8/1965 | Gorike et al. | 381/91 |
| 3,418,427 | 12/1968 | Hoffmann | 181/160 X |
| 4,376,232 | 3/1983 | Martin | 181/160 X |
| 4,410,770 | 10/1983 | Hagey | 179/121 D |

FOREIGN PATENT DOCUMENTS

| | | | |
|---|---|---|---|
| 305690 | 7/1971 | Hungary | 181/160 |

*Primary Examiner*—Benjamin R. Fuller
*Attorney, Agent, or Firm*—Darby & Darby

[57] ABSTRACT

An acoustic equalizer adapted for use with a microphone includes a resonator plate having front and back faces, a lip surrounding the plate and defining a first air cavity in the back face of the plate, and a plurality of apertures formed through the thickness of the plate, which apertures communicate with the first cavity. A boss is formed centrally on the front face of the plate. The boss is closed ended on one side and hollow interiorly to define a second air cavity. The first and second cavities communicate with each other through a central opening formed in the plate.

5 Claims, 6 Drawing Figures

FIG. 1A
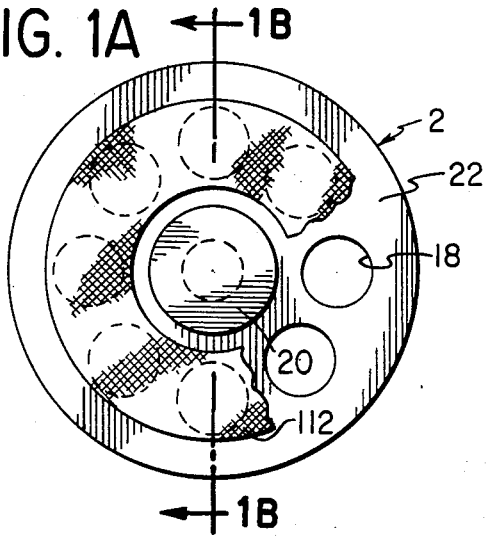
FIG. 1B
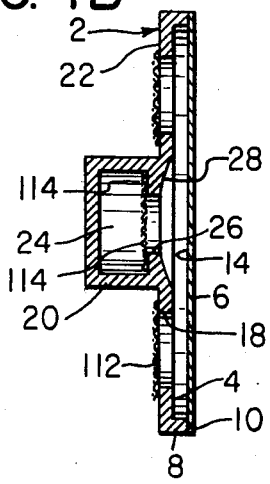
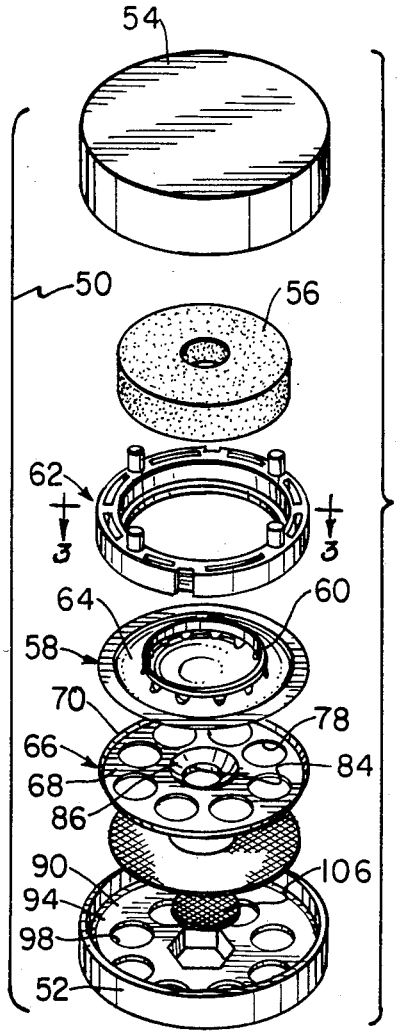
FIG. 2
FIG. 3
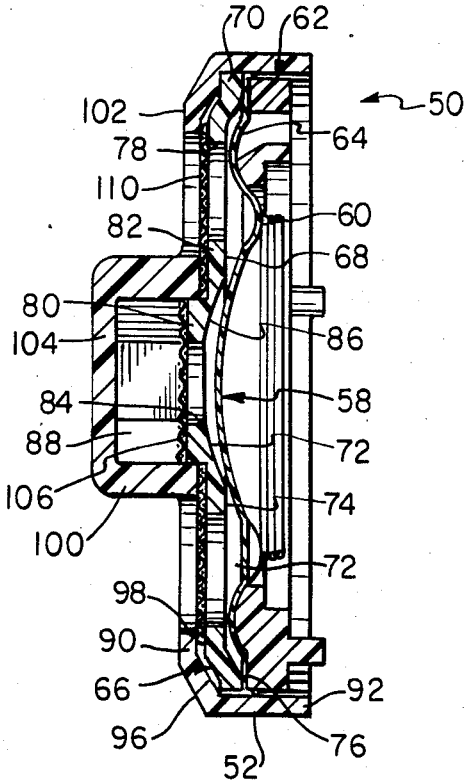

MICROPHONE AND ACOUSTIC EQUALIZER THEREFOR

BACKGROUND OF THE INVENTION

1. Field of the Invention

This invention relates to a design for microphones, and more particularly relates to a wide band microphone with an acoustic equalizer or resonator.

2. Description of the Prior Art

In order to extend the high frequency response of a microphone, it is well known in the art to position a resonator plate in front of the microphone. More particularly, such a plate includes a series of apertures formed through its thickness and situated peripherally about its center. In one known application, the plate may be positioned directed adjacent to the microphone diaphragm, and may include a lip surrounding the periphery of the plate and extending axially in the direction of the diaphragm, which lip abuts against the diaphragm to space it from the plate. The lip, plate and diaphragm thus define a cavity which communicates with the peripherally spaced apertures. This arrangement is commonly known as a Helmholtz resonator, and is frequently used in the industry as a cost saving measure to achieve an increased frequency sensitivity from a relatively low priced microphone.

Some microphones, without being fitted with such a resonator plate, can exhibit a roll-off in their frequency response at about 4 to 5 kHz. The frequency response of such microphones may be extended to as much as 20 kHz by mounting a Helmholtz resonator plate on the microphone, and tuning the resonator plate (by adjusting the thickness of the plate and number and size of the peripherally spaced apertures) to resonate at about 15 kHz.

Such a microphone is usually structured to define a back cavity or chamber of air adjacent to the back face of the diaphragm. Because of size and design constraints, this back chamber of air can resonate at a frequency of about 5 kHz, which causes an undesirable peak in the microphone's frequency response.

If the microphone is used without an equalizer, this undesirable peak in the frequency response is of little or no consequence, being outside the usable 4 kHz bandwidth of the microphone, as mentioned previously. However, when a conventional resonator plate is used in conjunction with the microphone to extend its frequency response, the undesirable peak becomes prevalent in the extended operating frequency range of the microphone, resulting in signal distortion.

A known method of suppressing such peaks is to dampen the signal by covering the peripherally spaced apertures of the resonator plate with a fabric mesh material or by adding similar material in communication with the back cavity or chamber. However, this method has the effect of attenuating the entire frequency response of the microphone, and little may not provide the ability to selectively eliminate an undesirable peak in the frequency response.

OBJECTS AND SUMMARY OF THE INVENTION

An object of the present invention is to provide an improved acoustic equalizer design for use with microphones to suppress undesirable peaks in the frequency response of the microphone.

Another object of the invention is to provide an improved acoustic equalizer for use with a microphone, which equalizer can be constructed so that it is tuned to an unwanted peak in the frequency response of the microphone.

A further object of the invention is to provide a microphone with an extended and relatively flat frequency response.

In accordance with one embodiment of the invention, a conventional Helmholtz resonator plate, such as described previously, formed as a round plate with peripheral apertures and a lip, is modified to include a closed ended, hollow boss centrally disposed on and extending outwardly from the outer surface of the plate. The boss defines an internal chamber or air cavity. A central opening is formed through the thickness of the plate to allow the air cavity defined by the boss to communicate with an air chamber defined by the lip and back face of the plate and the microphone diaphragm. The dimensions of the boss can be selected to provide an air cavity that resonates at a predetermined frequency, thus making it possible to tune the resonance to the undesirable peak in the microphone's frequency response. Thus, the unmodified portion of the plate provides the microphone with an extended operating frequency range, while the modified portion (the boss and its air cavity) acts as a "notch" filter, the dimension of which can be selected to ooincide with any undesirable peak in the microphone's frequency response to null the peak.

In a preferred form of the invention, the acoustic equalizer may be formed integrally with the front cover or shock mount of the microphone. The microphone includes a resonator plate, which has a number of peripheral apertures and a peripheral lip, as described with the previous embodiment. The plate further includes a partial boss formed on its outer face. The boss is hollow and open on each end. A second hollow boss is formed centrally on the front cover of the microphone. The boss of the front cover is closed on the cover's front face and defines an air cavity. The air cavity is open ended on the back face of the front cover. A number of peripheral apertures are also formed through the thickness of the front cover.

When the microphone is assembled, the boss of the resonator plate is received by the cavity defined by the boss of the cover, and the apertures of the cover are aligned with the apertures of the plate. The air cavity in front of the resonator plate (defined by the boss of the front cover) thus communicates with the air cavity situated between the back of the resonator plate and the microphone diaphragm. As in the previous embodiment, the air cavity of the cover's boss resonates at a predetermined frequency, which is tunable by selecting the particular dimensions of the bosses of the cover and resonator plate.

Preferred forms of the acoustic equalizer, as well as other objects, features and advantages of this invention, will become apparent from the following detailed description of illustrative embodiments thereof, which is to be read in connection with the accompanying drawings.

BRIEF DESCRIPTION OF THE DRAWINGS

FIGS. 1A and 1B are respective diagrammatic front and vertical section views of one form of the acoustic equalizer according to the present invention.

FIG. 2 is an exploded isometric view of an alternative form of the acoustic equalizer and microphone according to the present invention.

FIG. 3 is a partial section view of the microphone and acoustic equalizer shown in FIG. 2, taken along lines 3—3 of FIG. 2.

DETAILED DESCRIPTION OF THE PREFERRED EMBODIMENTS

Figure 4:
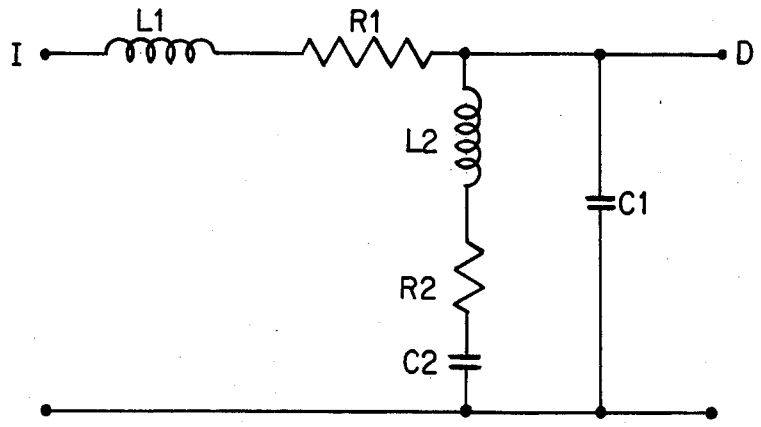
FIG. 4 is the equivalent electrical schematic circuit of the equalizer shown in FIGS. 1A and 1B.

Referring initially to FIGS. 1A and 1B of the drawings, it will be seen that an acoustic equalizer for use with a microphone, according to the present invention, includes an overall flat "resonator" plate 2, made of plastic or other suitable material. The plate 2 may be disc shaped and adapted to fit with its back face 4 coaxially adjacent to the diaphragm 6 of a microphone.

The plate 2 includes a lip 8 formed entirely about its peripheral edge. The lip 8 extends perpendicularly outwardly from the back face 4 of the plate 2 a relatively short distance (that is, relative to the overall diameter of the plate), so that the most outward edge 10 of the lip 8 abuts the front face 14 of the diaphragm 6 near its periphery, so as not to restrict the movement of the diaphragm 6. Thus, an air cavity or chamber 16 is defined at the back face 4 of the plate 2, that is, between the plate 2 and the microphone diaphragm 6.

The resonator plate 2 includes a number of apertures 18 formed through its thickness. These apertures 18 are equally spaced concentrically about the plate's center, near the plate's peripheral edge. Each aperture 18 has the same diameter. The spacing between apertures 18, their location on the plate 2 and diameter of the apertures 18 are selected in a well known manner. Thus, the apertures 18 communicate with the air cavity 16 between the plate 2 and the diaphragm 6. The air in the apertures 18 and air cavity 16 resonates with movement of the diaphragm 6, which has the effect of extending the higher frequency range of the microphone.

The plate 2 further includes a boss 20 formed centrally on the front face 22 of the plate 2 and extending outwardly therefrom. The boss 20 is hollow to define a air cavity 24 in its interior. The exterior and interior shape of the boss 20, viewed axially to the plate 2, may be round or polygonal; it need not matter specifically, as long as the interior of the boss 20 defines a predetermined volume.

The plate 2 further includes an opening 26 formed centrally through its thickness. This opening 26 provides an air path between the air cavity 24 of the boss 20 and the chamber 16 of the diaphragm 6; in other words, the air cavity 24 and chamber 16 communicate with each other through this opening 26.

The back face 4 of the plate 2 may include a circular depression or slightly countersunk opening 28 formed therein, which is aligned with and leads to the central opening 26 formed in the plate 2. This countersunk opening 28 is provided to allow clearance for the diaphragm 6, and in particular, the dome 30 of the diaphragm 6 (see FIG. 3), so that only a small air space or chamber 16 is defined between the back face 4 of the resonator plate 2 and the diaphragm 6.

In the alternative form of the invention illustrated by FIGS. 2 and 3 of the drawings the acoustic equalizer may be integrally formed at least partially as part of the microphone's housing.

The microphone 50 includes overall cylindrical, mating front and rear housings 52, 54. A number of conventionally known components are situated within the housings 52, 54. Such components include a magnetic structure sub-assembly 56, a diaphragm 58 and a voice coil 60 joined to the diaphragm 58 and positioned adjacent to the magnetic structure sub-assembly 56. A ring-shaped diaphragm carrier 62 supports the diaphragm 58 on its back face 64.

The microphone 50 further includes a resonator plate 66. As described previously with the embodiment shown in FIGS. 1A and 1B, the resonator plate 66 has an overall disc shape. It includes a flat main body portion 68 which gradually extends peripherally into a radially extending edge flange 70. The edge flange 70 is offset axially from the plane in which the main body 68 resides to define a cavity 72 at the back face 74 of the plate 66, in much the same way as the lip 12 and plate 2 define a cavity in the embodiment of FIGS. 1A and 1B.

The overall diameter of the plate 66 is chosen so as to cooperate with the diaphragm carrier 62 in retaining the diaphragm 58 and voice coil 60 in place when the microphone 50 is assembled. More specifically, a flat side 76 of the edge flange 70 abuts the microphone diaphragm 58 only at the diaphragm's extreme periphery so as not to interfere with movement of the diaphragm 58.

As in the previous embodiment, the resonator plate 66 includes a number of apertures 78 formed through its thickness and situated concentrically about the plate's center on its main body 68. These apertures 78 are preferably equally spaced apart from each other, and of the same diameters. The apertures 78 thus communicate with the cavity 72 formed in the back face 74 of the plate, 66 defined between the plate 66 and the diaphragm 58.

The resonator plate 66 further includes a "partial" boss 80. What is meant by a partial boss 80 is that it protrudes only slightly from the surface of the plate 66, as opposed to the substantially protruding boss 20 of the previously discussed embodiment.

The "partial" boss 80 is formed centrally on the front face 82 of the plate's main body 68 and extends only slightly outwardly therefrom. It does not alone define an air cavity, but rather defines a resonating air cavity with the front housing 52 of the microphone 50, as will be seen.

The boss 80 includes a central opening 84 formed axially through its thickness. As in the embodiment of FIGS. 1A and 1B, the opening 84 may be slightly countersunk to form a circular depression 86 on the back face 74 of the plate 66.

In a preferred form, the exterior shape of the partial boss 80, when viewed axially, is hexagonal, while the central opening 84 is circular. However, the boss 80 may suitably have other exterior shapes, such as circular or polygonal.

As will now be explained, the microphone's front housing 52 is shaped to define an air cavity 88 in front the resonator plate 66. The front housing 52 includes an overall disc shaped cover plate 90, and cylindrical side walls 92 extending axially from the periphery of the cover plate 90.

The internal dimensions of the front housing 52 are such that it can closely receive and tightly hold the resonator plate 66 against the back face 94 of the cover plate 90, and of course house the other microphone elements. In this regard, the back surface 94 of the cover plate 90, where it joins the cylindrical walls 92 of the housing 52, includes a bevelled corner 96 that conforms to the front edge configuration of the resonator plate 66.

The cover plate 90 of the front housing 52 has a number of apertures 98 formed through its thickness and concentrically situated about its center. The number, size and spacing of these apertures 98 correspond exactly with the apertures 78 formed in the resonator plate 66, so that when the microphone 50 is assembled, the apertures 98, 78 of the cover plate 90 and resonator plate 66 can be in exact alignment.

The front housing 52 includes a boss 100 formed centrally on the cover plate 90. The boss 100 extends outwardly from the front face 102 of the cover plate 90, includes a closed front end 104, and is hollow interiorly to define an air cavity 88 that is open ended at the back face 94 of the cover plate 90. The shape and dimensions of the interior of the boss 100 are such as to allow the cavity 88 to closely receive the partial boss 80 of the resonator plate 66. Thus, for example, if the partial boss 80 is hexagonal in shape, the interior of the boss 100 is complementary shaped to be hexagonal.

When the microphone 50 is assembled, the boss 100 of the front housing 52 and partial boss 80 of the resonator plate 66 define an air cavity 88 that communicates with the diaphragm air chamber or cavity 72 through the central opening 84 formed in the resonator plate 66.

As with the previous embodiment, the microphone 50 shown in FIGS. 2 and 3 may have its acoustic equalizer tuned to resonate, and provide a null, at a particular frequency. By selecting the overall dimensions of the central opening 84 of the resonator plate 66, that is, the diameter of the opening 84 and the thickness of the resonator plate 66 where the opening 84 is formed, and the interior dimensions (i.e., the volume) of the air cavity 100, the equalizer can be adjusted to resonate at a frequency that coincides with an undesirable peak in the microphone's frequency response.

It may be found that in practice a certain damping of the microphone's frequency response is required. If such damping is necessary, a fabric cloth or synthetic mesh material 106 may be adhesively secured to the front face 108 of the partial boss 80. Similar material shaped in the formed of a ring 110 may be secured to the front face 82 of the resonator plate 66 to cover the apertures 78, for damping purposes or to act as a particle trap. The thickness and type of material used can be chosen to provide the required amount of damping, in accordance with known practice.

A similar cloth or fabric material may be provided for the equalizer shown in FIGS. 1A and 1B. A ring shaped cloth 112 may be secured to the front face 22 of the resonator plate 2 to cover the apertures 18, and a second cloth sheet 114 may be secured to the back face 4 of the resonator plate 2 to cove the central opening 26.

The equivalent electrical circuit of the acoustic equalizer of FIGS. 1A and 1B is shown schematically in FIG. 4.

L1 represents the inductance of the apertures 18 formed in the resonator plate 2. Terminal I of the circuit of FIG. 4 represents the sound input to the equalizer, and terminal D represents the output to the microphone's diaphragm 6.

C1 represents the capacitance of the cavity or air chamber 16 formed between the back face 4 of the resonator plate 2 and the microphone's diaphragm 6.

If a particle trap or damping material 112 is used in the microphone to cover the plate apertures 18, such is represented by resistance R1.

The central opening 26 and air cavity 24 of the resonator plate 2 respectively add an inductance L2 and capacitance C2, connected together in series, the series combination being coupled in parallel with capacitance C1 representing the diaphragm air cavity 16. If damping material 114 is added to cover the central opening 26 in the resonator plate 2, such damping is represented schematically by resistance R2, in series with inductance L2 and capacitance C2.

As is well known in the electroacoustic and electromechanical arts, the equivalent capacitance of an air cavity is equal to the volume of the cavity, divided by a known constant.

In a C.G.S. measurement system, the following formula may be used:

$$C = \frac{V}{1.43 \times 10^6 \text{ cm}^3/\text{farads}} \qquad \text{Eq. (1)}$$

where

C represents the equivalent capacitance in farads, and

V represents the volume of the cavity in cubic centemeters.

As is well known, the equivalent inductance of an opening can be approximated by the following equation:

$$L = \frac{\rho o(t + 1.226\, r)}{\pi r^2} \qquad \text{Eq. (2)}$$

where

L represents the equivalent inductance of the opening in henries, represents the density of air at room temperature, or 0.00118 grams/cm$^3$, t represents the thickness of the opening (i.e., the resonator plate) in cm, and r represents the radius of the opening in cm.

The resonant frequency of the air within the cavity is, from electrical theory, inversely proportional to the square root of the inductance multiplied by the capacitance, or $$f_o = \frac{1}{2\pi\sqrt{LC}} \qquad \text{Eq. (3)}$$

where $f_o$ represents the resonant frequency in hertz,

L represents the inductance in henries and

C represents the capacitance in farads.

EXAMPLE

Figure 5:
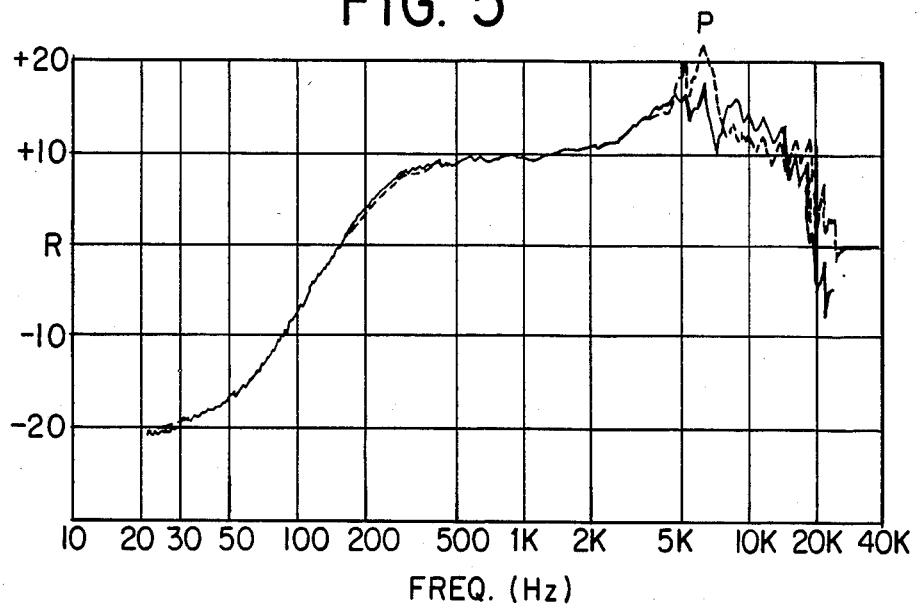
FIG. 5 is a graph with overlaid curves representing the frequency response of a microphone with a conventional resonator and with a resonator modified according to the present invention.

Reference is now made to FIG. 5 of the drawings, which shows overlaid curves of a dynamic microphone (Model 757, manufactured by Electro-Voice, Inc.) fitted in one case with a conventional Helmholtz resonator (shown as a dotted curve) and in the other case with a similar resonator but modified to define a central opening and air cavity according to the invention described herein (shown as a solid curve).

The Model 757 microphone without any resonator has a characteristic frequency roll off at about 5,000 Hz. By adding a conventional resonator with aperture characteristics selected in a known manner, the operable frequency range of the microphone is extended to between 15 kHz and 20 kHz, as shown by the dotted curve of FIG. 5.

However, an undesirable peak identified on the graph by the letter P appears at an approximate center frequency of about 6200 Hz in the region extended by the conventional resonator.

An acoustic resonator as described herein according to the present invention was constructed. The air cavity 24 defined by the boss 20 was formed with an overall volume of 0.25 $cm^3$. According to Equation 1, the equivalent capacitance of the cavity 24 was calculated as follows:

$$C = \frac{V}{1.43 \times 10^6} \quad \text{(Eq. (1)}$$

$$C = \frac{.25}{1.43 \times 10^6}$$

$$C = 1.75 \times 10^{-7} \text{ Farads}$$

The central opening 26 in the resonator plate 2 was formed with a radius of 0.234 cm, and the plate 2 at the opening 26 had a thickness of 0.089 cm.

Using Equation 2, the equivalent inductance of the opening 26 is calculated below:

$$L = \frac{\rho o(t + 1.226r)}{\pi r^2} \quad \text{Eq. (2)}$$

$$L = \frac{.00118(.089 + 1.226(.234))}{\pi(.234)^2}$$

$$L = 2.58 \times 10^{-3} \text{ henries}$$

The resonant frequency of the cavity 24 is calculated from Equation 3, as shown below:

$$f_o = \frac{1}{2\pi\sqrt{LC}} \quad \text{Eq. (3)}$$

$$f_o = \frac{1}{2\pi\sqrt{(.00258)(1.75 \times 10^{-7})}}$$

$$f_o \cong 7500 \text{ Hz}$$

Thus, the acoustic equalizer was particularly constructed to resonate at a frequency of approximately 7500 Hz. The model 757 microphone was fitted with this equalizer, and its frequency response was plotted, as shown by the solid curve of FIG. 5.

It is evident from a comparison of the overlaid curves of FIG. 5 that the undesirable peak in the microphone's frequency response was reduced by the equalizer constructed in accordance with the present invention. It is further evident that a strong null appears in the solid curve at about 7500 Hz. If the equalizer had been tuned to exactly 6200 Hz, the peak would have been even more substantially reduced, and the resultant dip or null in the solid curve would have not been as deep, resulting in a more uniform and flattened response. It should be further noted that the same extended frequency range is provided by the acoustic equalizer of the present invention as is provided by a conventional Helmholtz resonator.

The microphone acoustic equalizer according to the present invention is simple in structure and is adaptable to be formed at least partially integrally with the microphone's housing, or independent thereof and fitted adjacent to the diaphragm of an assembled microphone. Its ability to be selectively tuned to a precise frequency allows it to null or attenuate an undesirable peak in the microphone's frequency response.

Although illustrative embodiments of the present invention have been described herein with reference to the accompanying drawings, it is to be understood that the invention is not limited to those precise embodiments, and that various other changes and modifications may effected therein by one skilled in the art without departing from the scope or spirit of the invention.

What is claimed is:

1. A microphone and acoustic equalizer therefor, which comprises:

a magnetic structure;

a diaphragm adjacent to the magnetic structure;

a voice coil operatively coupled to the diaphragm;

means for supporting the diaphragm;

a resonator plate having a front face and a back face opposite the front face, the resonator plate including a flat main body portion and an edge flange joined to the main body portion at the periphery thereof, the edge flange being offset axially from the main body portion to define a first air cavity in the back face of the plate, the edge flange being adapted to abut the periphery of the microphone diaphragm;

the plate including a plurality of apertures formed through its thickness which communicate with the first air cavity;

a first boss formed centrally on the front face of the plate and protruding outwardly therefrom, the first boss including a central opening formed axially through its thickness;

a housing enclosing the magnetic structure, diaphragm, voice coil, diaphragm supporting means and resonator plate, the housing including a front cover plate disposed proximately to the resonator plate, the front cover plate having a front face and a back face opposite the front face, and a number of apertures formed through its thickness, the apertures of the cover plate being aligned with corresponding apertures of the resonator plate; and a second boss formed centrally on the front face of the cover plate and protruding outwardly therefrom, the second boss having a closed front end and being hollow interiorly to define a second air cavity of a predetermined volume, the second cavity communicating with the first cavity through the opening formed in the resonator plate.

2. A microphone and acoustic equalizer therefor, as defined by claim 1, wherein the housing further includes side walls joined to and extending from the front cover plate, and a beveled corner situated where the front cover plate is joined to the side walls.

3. A microphone and acoustic equalizer therefor, as defined by claim 1, wherein the resonator plate further includes a depression formed on its back face in alignment with the central opening.

4. A microphone and acoustic equalizer therefor, as defined by claim 1, which further includes a particle trap, the particle trap being formed of a woven mesh material, the particle trap being secured to the front face of the resonator plate and being dimensioned to cover the apertures formed therein.

5. A microphone and acoustic equalizer therefor, as defined by claim 1, which further includes a resonator damping, the resonator damping being formed of a woven mesh material, the resonator damping being secured to the first boss and dimensioned to cover the opening formed in the resonator plate.

* * * * *